US012310454B2

(12) United States Patent
Nethongkome et al.

(10) Patent No.: US 12,310,454 B2
(45) Date of Patent: May 27, 2025

(54) ARTICLE OF FOOTWEAR INCLUDING A SUPPORT FLAP

(71) Applicant: Nike, Inc., Beaverton, OR (US)

(72) Inventors: Benjamin Nethongkome, Beaverton, OR (US); Derek Houng, Portland, OR (US); Kreig Hozalski, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/356,645

(22) Filed: Jul. 21, 2023

(65) Prior Publication Data

US 2024/0023674 A1 Jan. 25, 2024

Related U.S. Application Data

(60) Provisional application No. 63/369,125, filed on Jul. 22, 2022.

(51) Int. Cl.

| | |
|---|---|
| ***A43B 23/02*** | (2006.01) |
| ***A43B 3/06*** | (2006.01) |
| ***A43B 23/26*** | (2006.01) |
| ***A43C 1/04*** | (2006.01) |

(52) U.S. Cl.

CPC ..... *A43B 23/0245* (2013.01); *A43B 3/06* (2013.01); *A43B 23/26* (2013.01); *A43C 1/04* (2013.01)

(58) Field of Classification Search

CPC ..... A43C 1/04; A43C 11/1493; A43C 1/00; A43C 1/003; A43C 11/00; A43C 11/004; A43C 11/008; A43C 11/14; A43B 7/1495; A43B 7/20

See application file for complete search history.

(56) References Cited

U.S. PATENT DOCUMENTS

| | | | | |
|---|---|---|---|---|
| 7,444,768 | B2 * | 11/2008 | Friton | A43C 7/00 36/50.1 |
| 8,156,664 | B2 | 4/2012 | Shepherd et al. | |
| 8,302,329 | B2 * | 11/2012 | Hurd | A43B 23/08 36/89 |
| 8,522,455 | B2 * | 9/2013 | Rasmussen | A43C 11/1493 36/50.1 |
| 8,857,077 | B2 * | 10/2014 | Kahatsu | A43C 1/04 36/91 |
| 8,863,411 | B2 | 10/2014 | Berger et al. | |
| 9,723,891 | B2 * | 8/2017 | Xanthos | A43B 5/08 |

(Continued)

OTHER PUBLICATIONS

International Search Report in PCT/US2023/070706, dated Nov. 7, 2023 (4 pages).

*Primary Examiner* — F Griffin Hall
(74) *Attorney, Agent, or Firm* — BOOKOFF MCANDREWS, PLLC.

(57) ABSTRACT

An article of footwear may include a heel region, a forefoot region, and a midfoot region, the midfoot region disposed adjacent to the forefoot region and the heel region, the article of footwear also including a medial side and a lateral side; an upper extending from the heel region to the forefoot region, wherein the upper includes a plurality of openings through which a fastener is configured to extend; a tongue extending from the forefoot region to the midfoot region; and a flap, the flap extending from the lateral side over a portion of the tongue, toward the medial side, wherein the flap includes a loop through which the fastener is configured to extend.

19 Claims, 10 Drawing Sheets

(56) References Cited

U.S. PATENT DOCUMENTS

| | | | | |
|---|---|---|---|---|
| 9,907,363 | B2 * | 3/2018 | Smith | A43B 3/126 |
| 10,004,296 | B2 * | 6/2018 | Zadnik | A43C 11/00 |
| 10,219,580 | B2 | 3/2019 | Taylor | |
| 11,324,283 | B2 | 5/2022 | Houng et al. | |
| 2003/0167655 | A1 * | 9/2003 | Sussmann | A43C 11/008 36/50.1 |
| 2003/0204970 | A1 | 11/2003 | Liu | |
| 2015/0013193 | A1 | 1/2015 | Krueger et al. | |
| 2016/0242498 | A1 * | 8/2016 | Sakamoto | A43B 13/04 |
| 2018/0295943 | A1 | 10/2018 | Fallon et al. | |
| 2019/0313741 | A1 | 10/2019 | Bell et al. | |
| 2020/0205524 | A1 * | 7/2020 | Hatfield | A43B 11/00 |
| 2020/0329819 | A1 * | 10/2020 | Durand | A43B 1/04 |
| 2021/0196002 | A1 * | 7/2021 | Cook | A43C 11/14 |
| 2021/0259356 | A1 | 8/2021 | Maselino et al. | |

* cited by examiner

ARTICLE OF FOOTWEAR INCLUDING A SUPPORT FLAP

CROSS-REFERENCE TO RELATED APPLICATION(S)

This application claims priority to U.S. Provisional Application No. 63/369,125, filed Jul. 22, 2022, the entirety of which is incorporated herein by reference.

FIELD

The present application relates generally to footwear having an upper and a support flap configured for securement of the upper around a foot.

BACKGROUND

This section provides background information related to the present disclosure which is not necessarily prior art.

Footwear may include a sole structure configured to be located under a wearer's foot to space the foot away from the ground. A footwear upper attached to the sole structure receives the foot. The fit of the upper to the foot may be adjusted with a closure system so that the upper is loose enough to receive the foot but can be tightened around the foot to secure the foot relative to the sole structure. A closure system may provide added stability to the footwear to secure the foot.

Sole structures generally include a layered arrangement extending between a ground surface and the upper. One layer of the sole structure includes an outer sole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
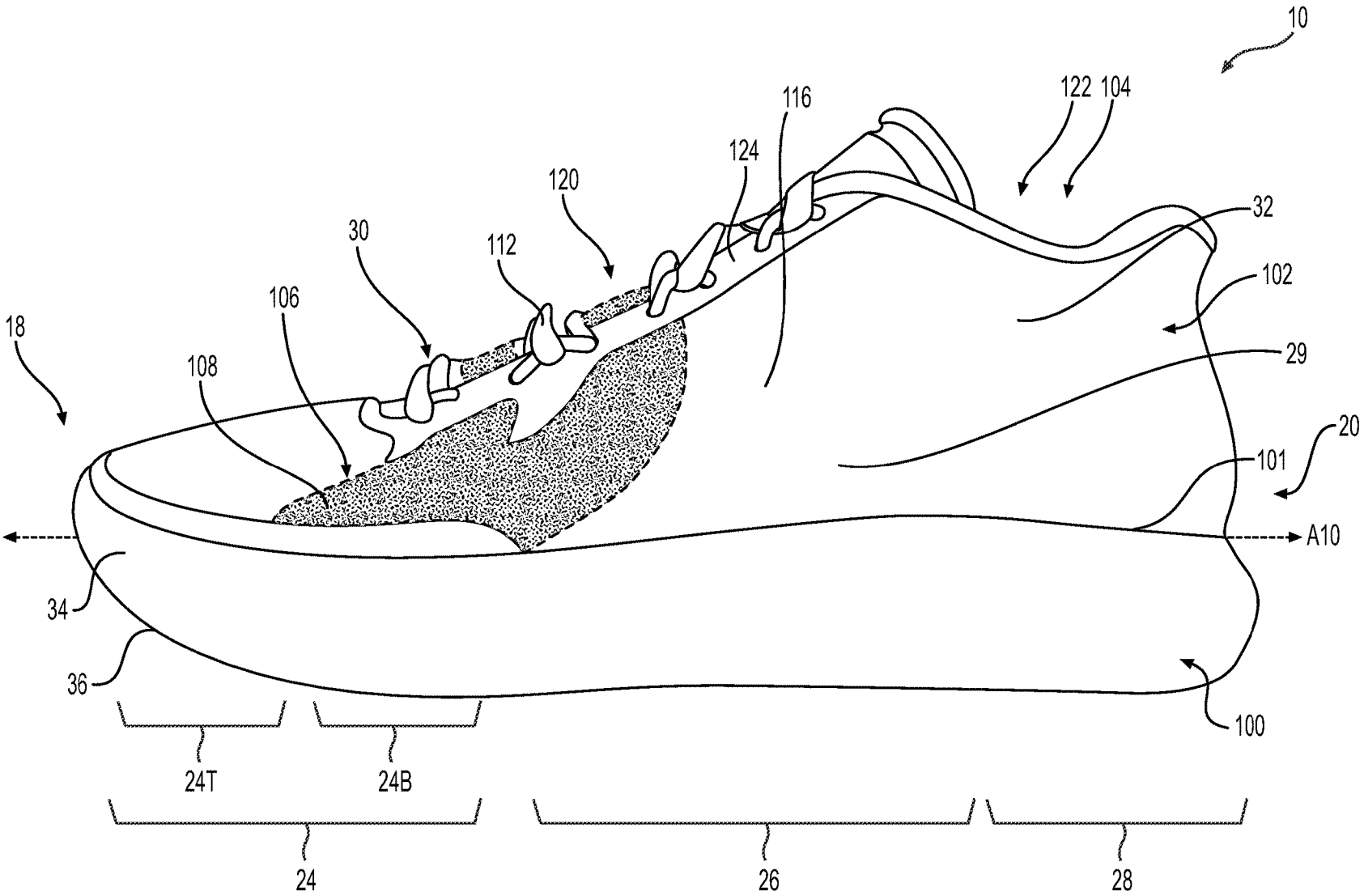
FIG. 1 is a side view of an article of footwear including a support flap.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

Sole Structure

Referring to the drawings, wherein like reference numbers refer to like components, FIG. 1 shows an article of footwear 10 that has a sole structure 100 and an upper 102 secured to the sole structure 100. Upper 102 and sole structure 100 may be attached in any manner. Embodiments can utilize any known methods for securing a sole structure to an upper, including various lasting techniques such as board-lasting, slip-lasting, combination-lasting, or strobel-lasting techniques. The upper 102 forms a foot-receiving cavity 104 configured to receive a foot (not shown). The upper 102 and the sole structure 100 are joined and/or meet at a bite line 101. Bite line 101 is the location along the periphery of the article of footwear 10 where upper 102 meets and/or joins sole structure 100.

In different embodiments, upper 102 may have a variety of different configurations. In particular, upper 102 may have any design, shape, size, and/or color. For example, in the exemplary embodiment, article 100 is a basketball shoe and so, therefore, upper 102 may have a high-top configuration that is shaped to provide high support on an ankle. In other embodiments, however, upper 102 could be configured as a low-top upper for basketball, running, or other activities.

The footwear 10 may be divided into a forefoot region 24, a midfoot region 26, a heel region 28, and an ankle region 32. The forefoot region 24 generally includes portions of the article of footwear 10 corresponding with the toes as well as portions of the article of footwear 10 corresponding with the joints connecting the metatarsals with the phalanges, also known as the ball of the foot. The forefoot region 24 is further divided into toe region 24T and ball region 24B. The midfoot region 26 generally includes portions of the article of footwear 10 corresponding with an arch area 29 and instep 30 of the foot, and the heel region 28 corresponds with rear portions of the foot, including the calcaneus bone. The ankle region 32 corresponds with the ankle. The forefoot region 24, the midfoot region 26, the heel region 28, and the ankle region 32 are not intended to demarcate precise areas of the footwear 10, but are instead intended to represent general areas of the footwear 10 to aid in the following discussion.

The sole structure 100 includes a midsole 34 and an outsole 36. The midsole 34 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 34 may incorporate fluid-filled chambers, plates, moderators, bladders or other elements that further attenuate forces, enhance stability, or influence the motions of the foot. The midsole 34 may be a single, one-piece midsole, or could be multiple components integrated as a unit. In some embodiments, the midsole 34 may be integrated with the outsole 36 as a unisole. The outsole 36 may be one-piece, or may be several outsole components, and may be formed from a wear-resistant rubber material that may be textured to impart traction and/or may include traction elements such as cleats secured to the midsole 34.

When the foot is positioned within the foot-receiving cavity 104 of the footwear 10, it is supported on a foot-facing surface of the midsole 34. The foot-facing surface of the midsole 34 may be covered by a strobel 114 (shown in FIG. 2) secured to a lower region of the upper 102. Also, optionally, an insole (not shown) may rest on the strobel 114 or directly on the sole structure 100 in embodiments without a strobel 114, in which case the foot is supported by both the sole structure 100 and the insole.

The footwear 10 may further include an anterior end 18 associated with a forward-most point of the forefoot region 24, and a posterior end 20 corresponding to a rearward-most point of the heel region 28. The footwear 10 includes a lateral side 42 (shown in FIG. 2) and a medial side 44 (shown in FIG. 2). The lateral side 42 and medial side 44 extend through each of the forefoot region 24, the midfoot region 26, the heel region 28, and the ankle region 32, and correspond with opposite sides of the article of footwear 10, each being positioned on an opposite side of a longitudinal midline axis A10 of the article of footwear 10. The medial side 44 is thus considered opposite to the lateral side 42.

A throat 120 extends across the top of the upper 102 and defines the instep region 30 extending between the lateral side 42 and the medial side 44 from the foot-receiving cavity 104 to the forefoot region 24. The foot-receiving cavity 104 is formed between a rearmost portion of the upper 102, the lateral side 42, and the medial side 44. Outermost edges of the throat 120 define a collar 124. The collar 124 cooperates with lateral side 42, the medial side 44, and the rearmost portion of the upper 102 to define an interior void 126 (shown in FIG. 3).

The upper 102 is tightened and secured around the foot with a closure system 106 that uses at least one flap 108, with flap loops 208 (shown in FIG. 2), and a lace (fastener) 112. The closure system 106 is operable between a tightened state and a loosened state via the flap 108 and the lace 112. Flap 108 includes one or more flap loops 208. Each flap loop 208 receives the lace 112, and the lace is pulled to secure the flap 108 over the instep region 30 of the article of footwear 10. The closure system 106 may transition the upper 102 between the tightened state and the loosened state. The tightened state corresponding with the pulling and subsequent tying of the lace 112 and the loosened state corresponding with the upper 102 being in a relaxed state.

Figure 2:
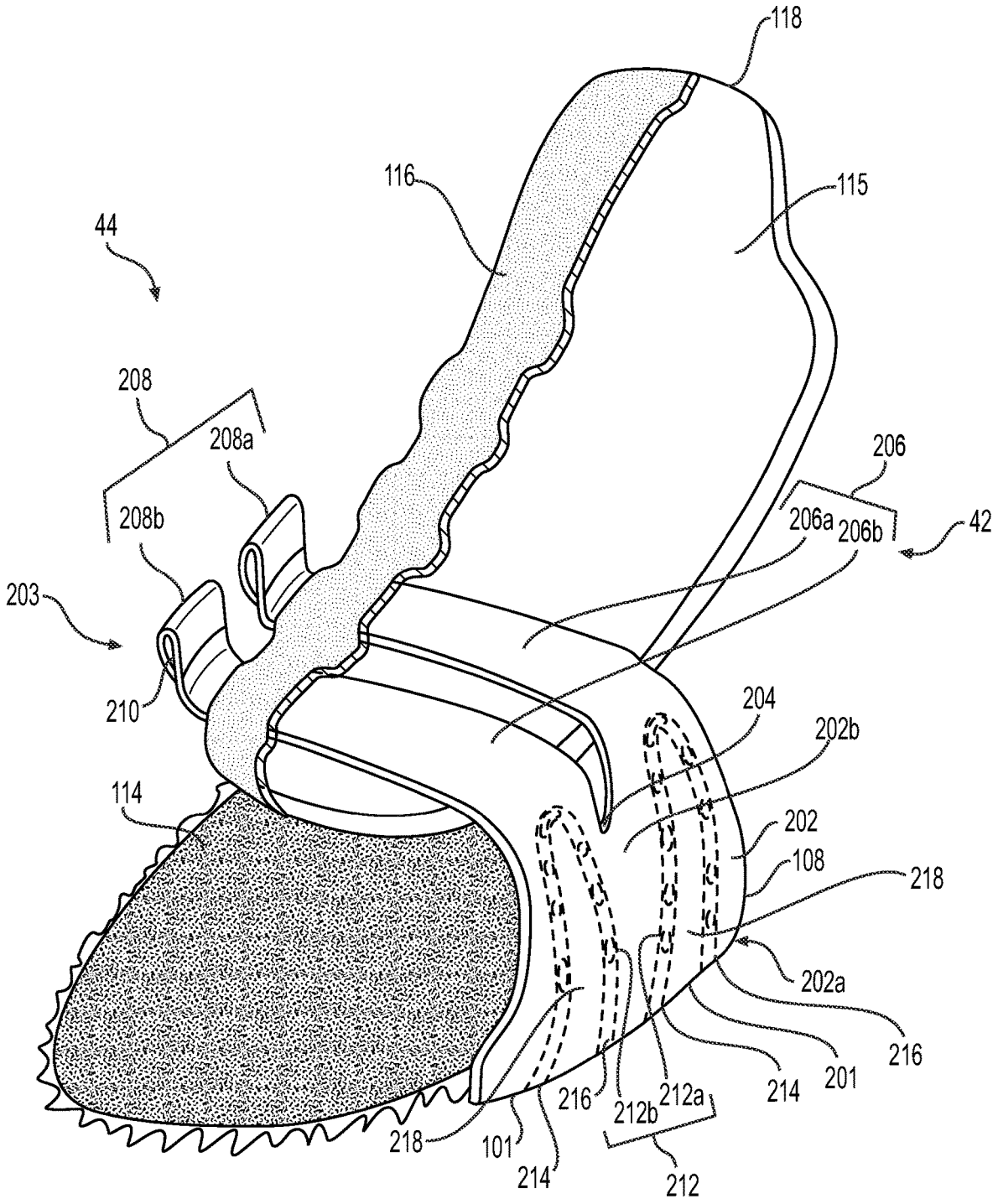
FIG. 2 is schematic view of the closure system of the article of footwear of FIG. 1.

Referring to FIG. 2, a tongue 118 may include a first inner layer 115 a second outer layer 116. The upper 102 and tongue 118 may include a variety of materials, such as mesh, leather, textiles, polymers, cotton, foam, composites, etc. One or both of first layer 115 and/or second layer 116 may include a material that has greater elasticity, greater breathability, or both greater elasticity and greater breathability than the material or materials of the flap 108 in order to aid with foot insertion and comfort. In other words, flap 108 may be stiffer than tongue 118 (and stiffer than each of layer 115 and layer 116). In an exemplary embodiment, first layer 115 may be comprised of a first material having a first elasticity. Second layer 116 may be comprised of a second material having a second elasticity. The first material of first layer 115 may be less elastic than the second material of the second layer 116. One or both the first layer 115 and/or the second layer 116 may include a polymeric material capable of providing elasticity. The polymeric material may include a braided construction, a knitted (e.g., warp-knitted) construction, or a woven construction. In some embodiments, the second layer 116 is of a mesh construction. In some embodiments, the second layer 116 includes a material that is transparent. In alternative embodiments, the second layer 116 may include a material that is opaque or translucent.

For example, the tongue 118, first layer 115, and outer layer 116 could be integral portions of a continuous sock upper. Second layer 116 is shown in a cut-away format in FIG. 2 to reveal flap 108 between layers 116 and 115.

Figure 2A:
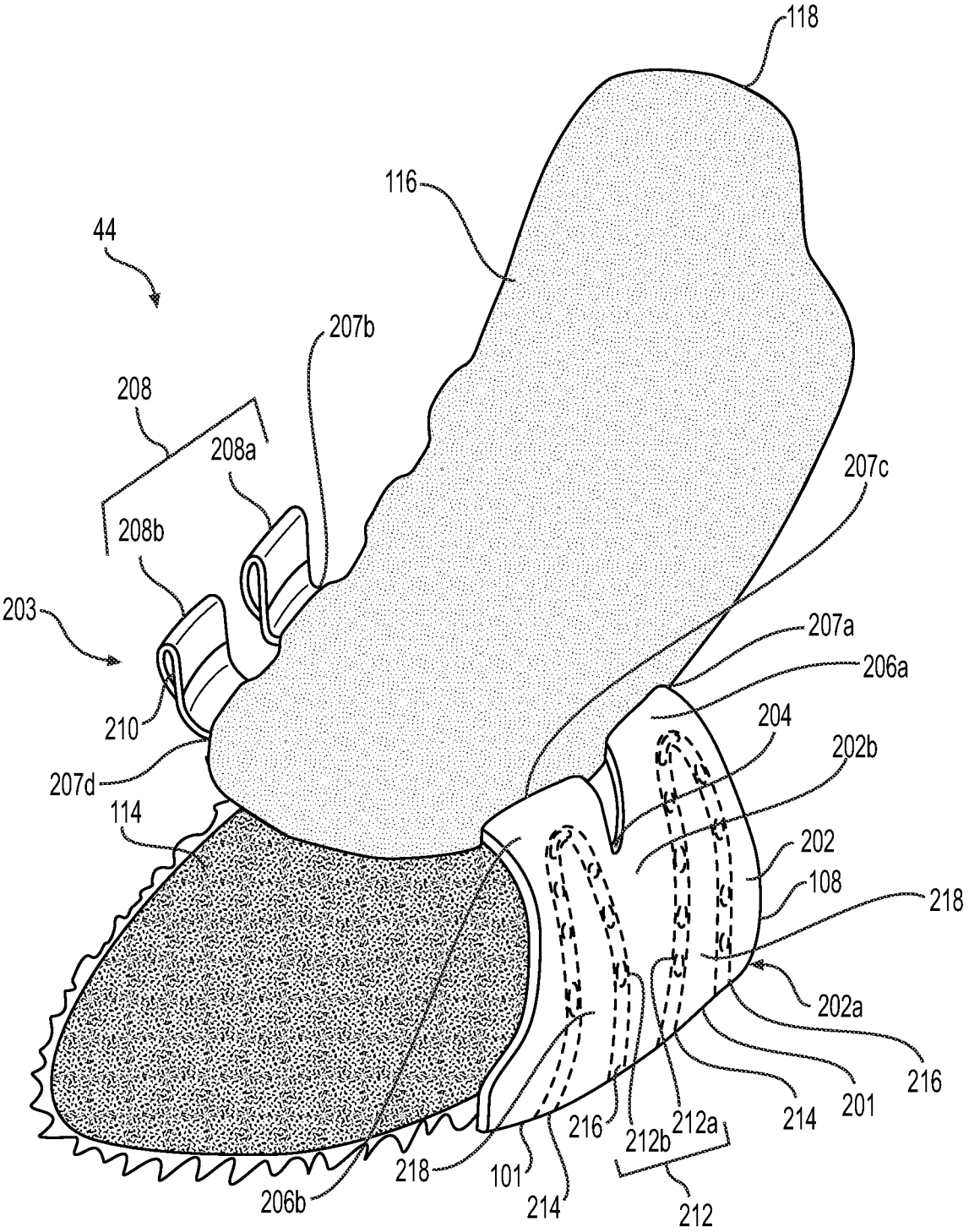
FIG. 2A is another schematic view of the closure system of the article of footwear of FIG. 1.

However, as can be seen in FIG. 2A, layer 116 extends across the entirety of first layer 115. In alternative embodiments, the tongue 118 may be separately secured to the first layer 115 and/or the second layer 116 of the upper 102.

Flap 108 also is shown in greater detail in FIG. 2. The flap 108 includes a base portion 202, a notch 204, fingers 206, and lace loops 208. In an exemplary embodiment, flap 108 includes a first finger 206*a* and a second finger 206*b*, and a first lace loop 208*a* and a second lace loop 208*b*. The lace loops 208 are positioned at the respective medial ends of the fingers 206 (e.g., first lace loop 208*a* is positioned at the medial end of the first finger 206*a*, and second lace loop 208*b* is positioned at the medial end of the second finger 206*b*). The base portion 202 includes a first end 202*a*. The first end 202*a* of the base portion 202 is fixed to the lateral side 42 of the upper 102 at a fixed portion 201 on or adjacent to bite line 101. The first end 202*a* is integral with or fixedly connected to the upper 102 at the lateral side 42. The base portion 202 also includes a second end 202*b*. The fingers 206 extend away from the second end 202*b* toward lace loops 208 positioned on the medial side 44. The fingers 206 are elongate members extending across the upper 102 and tongue 118. The notch 204 is disposed between the fingers 206. Thus, each of the fingers 206 extends around one side of the notch 204 to a respective lace loop 208. Each lace loop 208 includes an opening 210. The opening 210 is configured to receive the lace 112 therethrough (shown in FIG. 4). It is contemplated that in alternative embodiments, the fixed portion 201 may be integral with or fixedly connected to the sole structure 100 instead of to the upper 102. The flap 108 extends from the first end 202*a* of the base portion 202, across the instep region 30 (e.g., over at least a portion of the tongue 118 and the foot therein, at the instep region 30) to the free end 203 at the medial side 44 of the upper 102.

Accordingly, the flap 108 may be a transverse flap. The free end 203 of the flap may be a "free" end as it extends away from the outer layer 116 and the upper 102. As used herein, an "end" of a component is not limited to a terminal edge of a component, but instead also includes a portion of the component in the vicinity of the terminal end.

The flap 108 includes one or more cables, e.g., support cables 212. As shown in FIG. 2, flap 108 includes a first cable 212*a* and a second cable 212*b*, but fewer or additional cables 112 could be used. The cables 212 are disposed within the base portion 202, and have a height extending from the bite line 101 to the second end 202*b* of the base portion 202. Each cable 212 includes a first end 214 and a second end 216. The first end 214 and the second end 216 are each coupled at or adjacent the bite line 101, and are spaced apart from one another by a gap 218 so as to be arranged in an arch or U-shape. Each cable 212 may follow the arch shape of the gap 218 from the first end 214 to the second end 216. The cables 212 provide additional structural support to the flap 108.

It is contemplated that only one finger and lace loop may be present (without a notch), or that more than two fingers and more than one notch are included. For example, flap 108 may include three fingers and two notches, four fingers and three notches, or have another suitable combination of fingers and notches.

The flap 108, particularly each finger 206, is disposed between the first layer 115 and the second layer 116 of the tongue 118, and extends outside of first layer 115 and second layer 116 on both the lateral side 42 and the medial side 44. The tongue 118 extends over the instep region 30, and is disposed between the foot and the flap 108 at the instep region 30. The fingers 208 extend through or over the instep region 30. The flap 108 includes one or more materials that are stiffer than the tongue 118 to enhance a lockdown effect of the flap 108 over the foot, lending stability to the foot within the upper 102. The lockdown effect achieved by the flap 108 provides stability and added support to the article of footwear when lateral forces are applied.

The flap 108 may include a third material with a third elasticity that is less than the first elasticity of the first layer and the second elasticity of the second layer. For example, the flap 108 may be suede, leather, composites, a thermoplastic polyurethane, or the like. The closure system 106 provides an adjustable, secure fit to tighten the upper 102 around the foot, to thereby secure the foot relative to the sole structure 100 underlying the upper 102.

Figure 3:
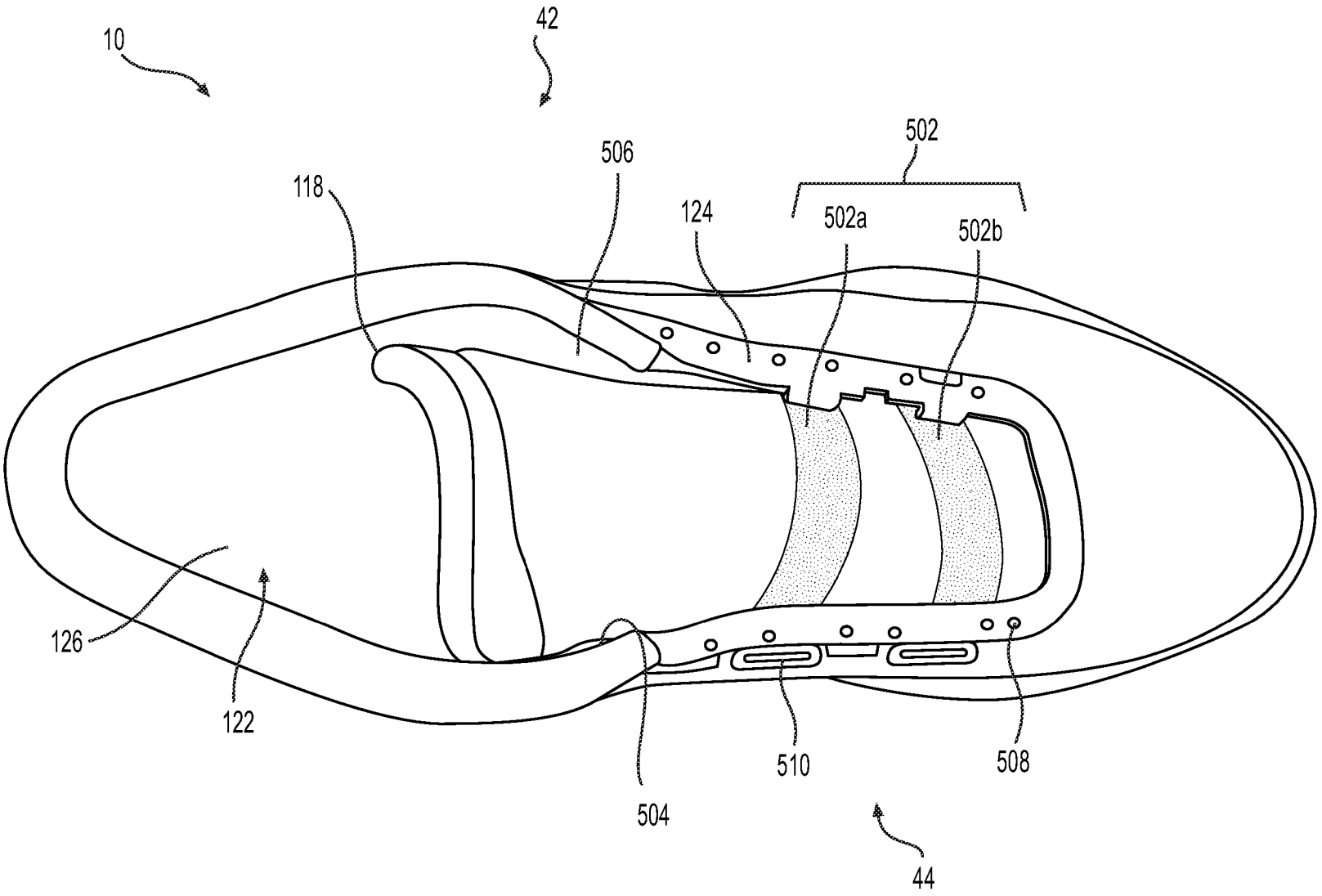
FIG. 3 is a top view of the article of footwear of FIG. 1 without a support flap.

Referring to FIG. 3, the tongue 118 includes one or more pockets 502 (e.g., pockets 502*a* and 502*b*) between layer 115 and layer 116. In one embodiment, it is contemplated that a single pocket is disposed between layer 115 and layer 116, and that each finger 206 extends through the single pocket. Alternatively, multiple pockets, e.g., pockets 502*a* and 502*b* may extend between layers 115 and 116, such that each finger 206 extends through a dedicated pocket. In the various embodiments, layers 115 and 116 may be stitched to or otherwise connected to one another at their peripheries, and each finger 206 may enter the pocket 502 through a respective slit on the medial or lateral side, and each finger 206 may exit the pocket through another respective slit on the medial or lateral side. For example, referring to FIG. 2A, finger 206*a* may enter tongue 118 via slit 207*a* on the lateral side, and exit tongue 118 via slit 207*b* on the medial side. Finger 206*b* may enter the tongue 118 via slit 207*c* on the lateral side, and exit tongue 118 via slit 207*d* on the medial side.

Pocket or pockets 502 extend from a medial edge 504 of the tongue 118 to a lateral edge 506 of the tongue 118. It is contemplated that there may be as many pockets 502 as is necessary to receive the fingers 206 of the flap 108, or as set forth above, one large pocket may be configured to receive all of the fingers 206.

The collar 124 includes one or more openings 508 and one or more apertures 510. The openings 508 are disposed on a medial side of the collar 124 and a lateral side of the collar 124. The openings 508 are configured to receive the lace 112 (shown in FIG. 6A). The openings 508 may be circular in shape or any other shape suitable for receiving the at least one lace 112. In an exemplary embodiment, the apertures 510 are disposed on the medial side 44 of the upper 102. The apertures 510 are disposed at or adjacent to the medial side of the collar 124. The apertures 510 are offset from the openings 508 and are larger than openings 508. The larger size of apertures 510 allow for each aperture 510 to receive a respective finger 206 and its associated lace loop 208 (shown in FIG. 6A). The apertures 510 may be ovular in shape or any shape suitable for receiving the fingers 206/lace loops 208.

Figure 4:
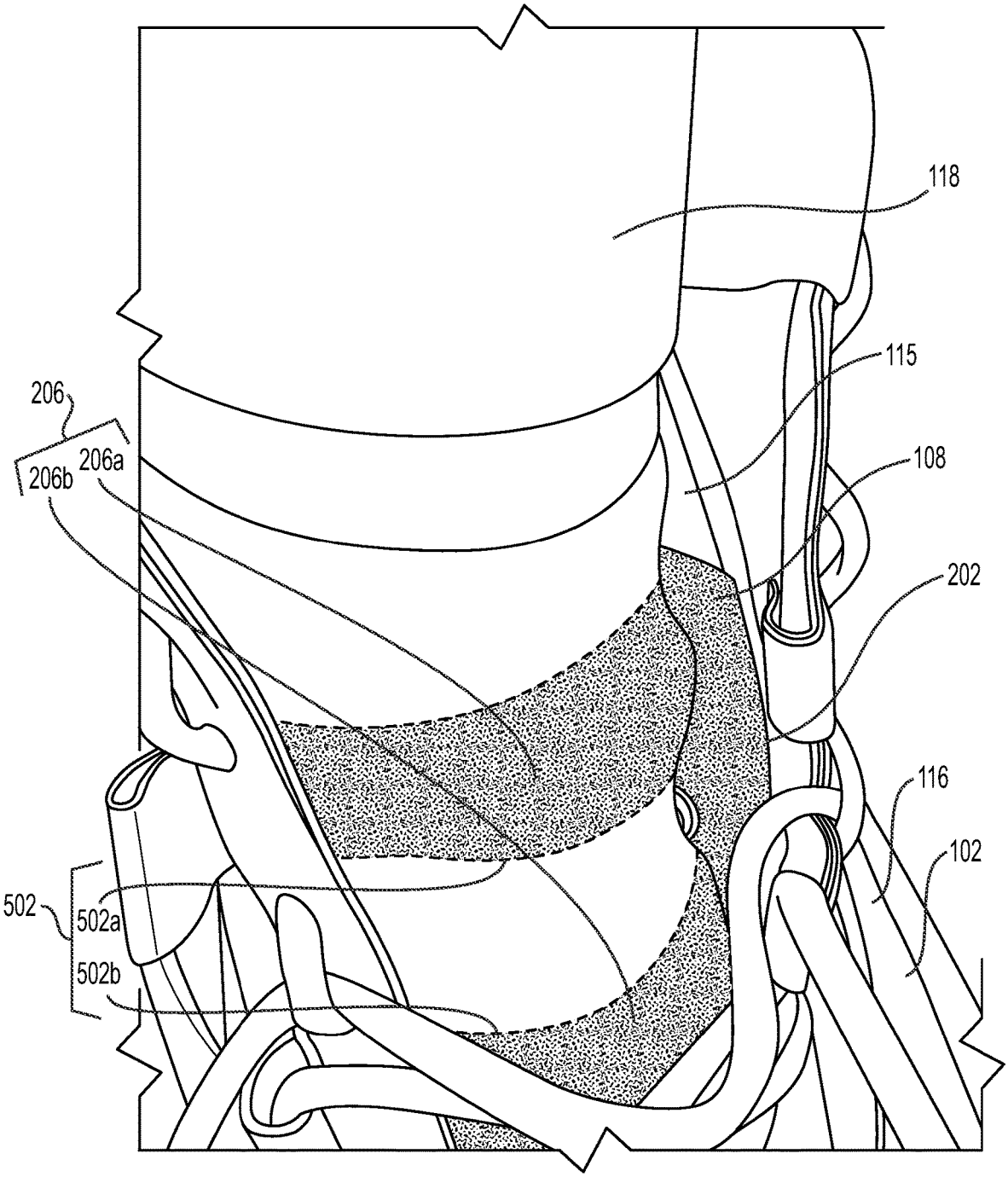
FIG. 4 is a zoomed-in perspective view of the article of footwear of FIG. 1.

Referring to FIG. 4, the base portion 202 of flap 108 is disposed between the tongue 118 and the lateral side 42 of the upper 102. The base portion 202 of the flap 108 extends from the bite line 101 to the tongue 118. The fingers 206 extend through the slits 207 across the tongue 118, through the one or more pockets 502, and the fingers 206 are slidably received through the pockets 502. The fingers 206 enter through the lateral edge 506 of the tongue 118, extend through one of the one or more pockets, and exit through the medial edge 504 of the tongue 118 (via slits as set forth above). The fingers 206 and the lace loops 208 also extend through the apertures 510 so that the lace loops 208 are positioned at an exterior surface of the upper 102 while other portions of their respective fingers extend through aperture 510. The lace 112 extends through the openings 508 and through the lace loops 208. Securing lace 112 through both openings 508 and lace loops 208 enables the closure system 106 to lockdown a foot of a user and provide lateral structural support when lateral shear forces are applied. There may be as many flaps 108 with any number of fingers 206 and lace loops 208 as is desired for providing lateral structural support.

Figure 5A:
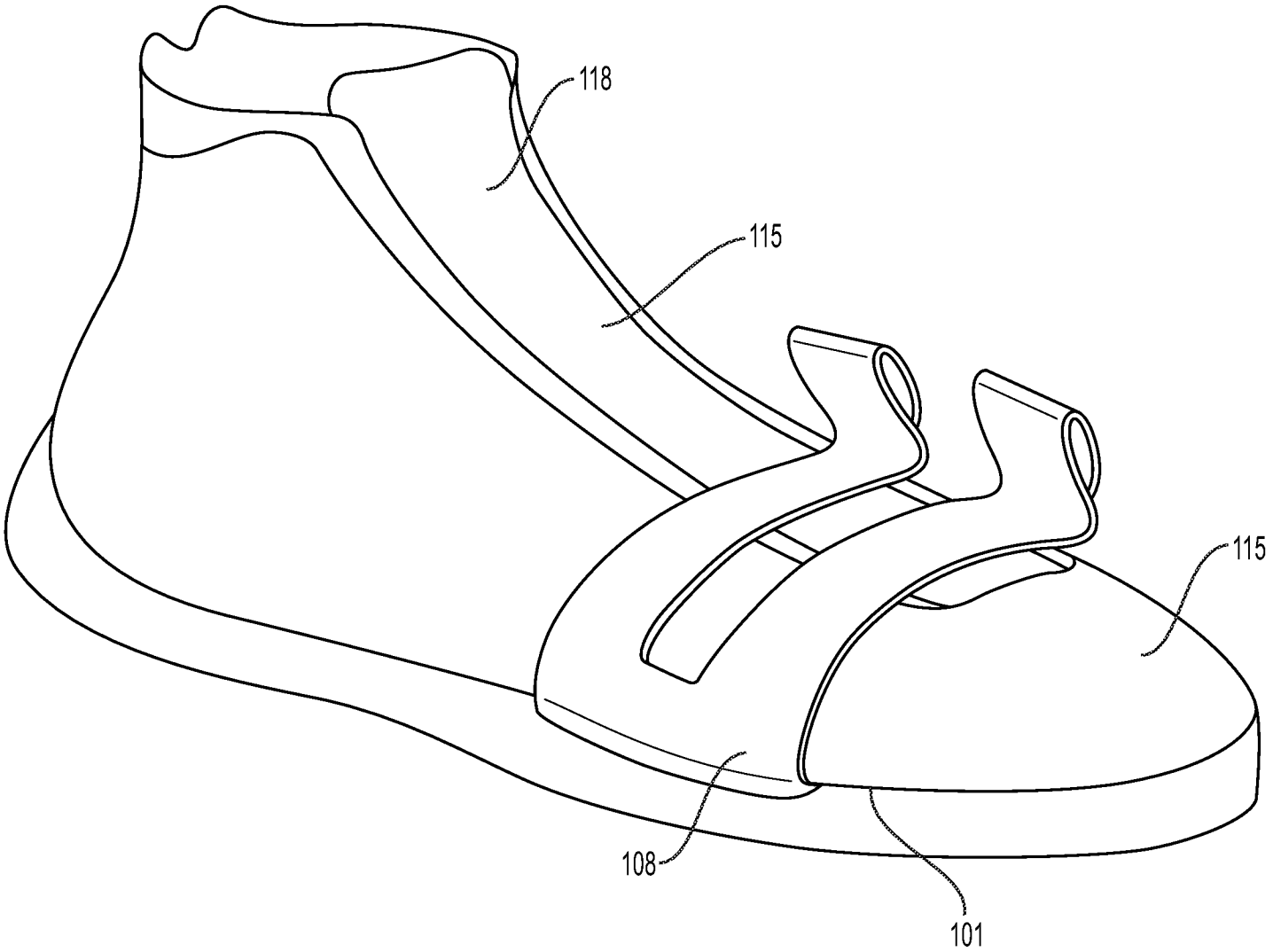
FIG. 5A is a lateral perspective view of the article of footwear.

Referring to FIG. 5A, the flap 108 extends over the first layer 115 and the tongue 118 in the forefoot region 24. For clarity purposes, the second layer 116 is not shown.

Figure 5B:
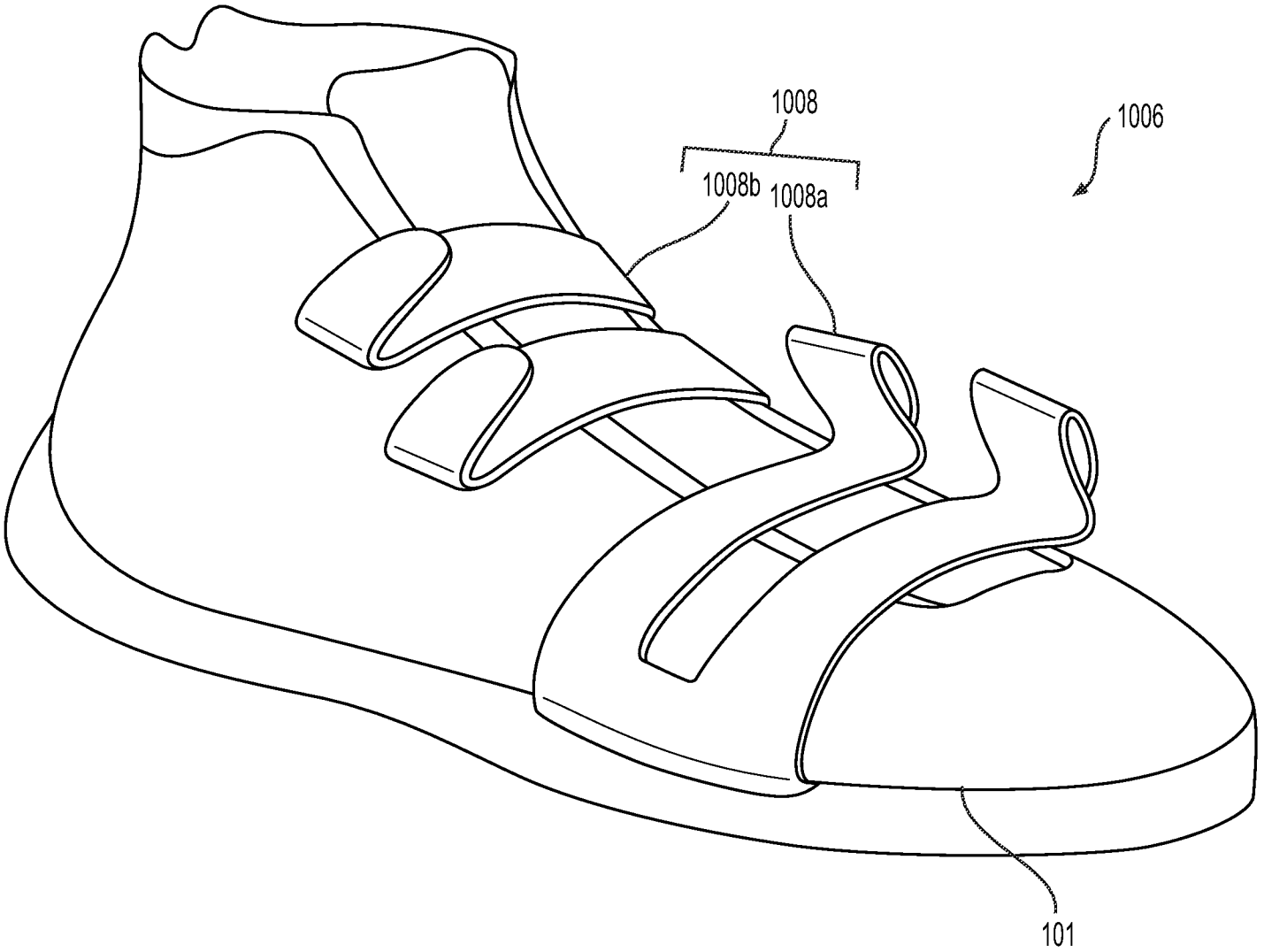
FIG. 5B is a lateral perspective view an alternative embodiment of the article of footwear.
Figure 5C:
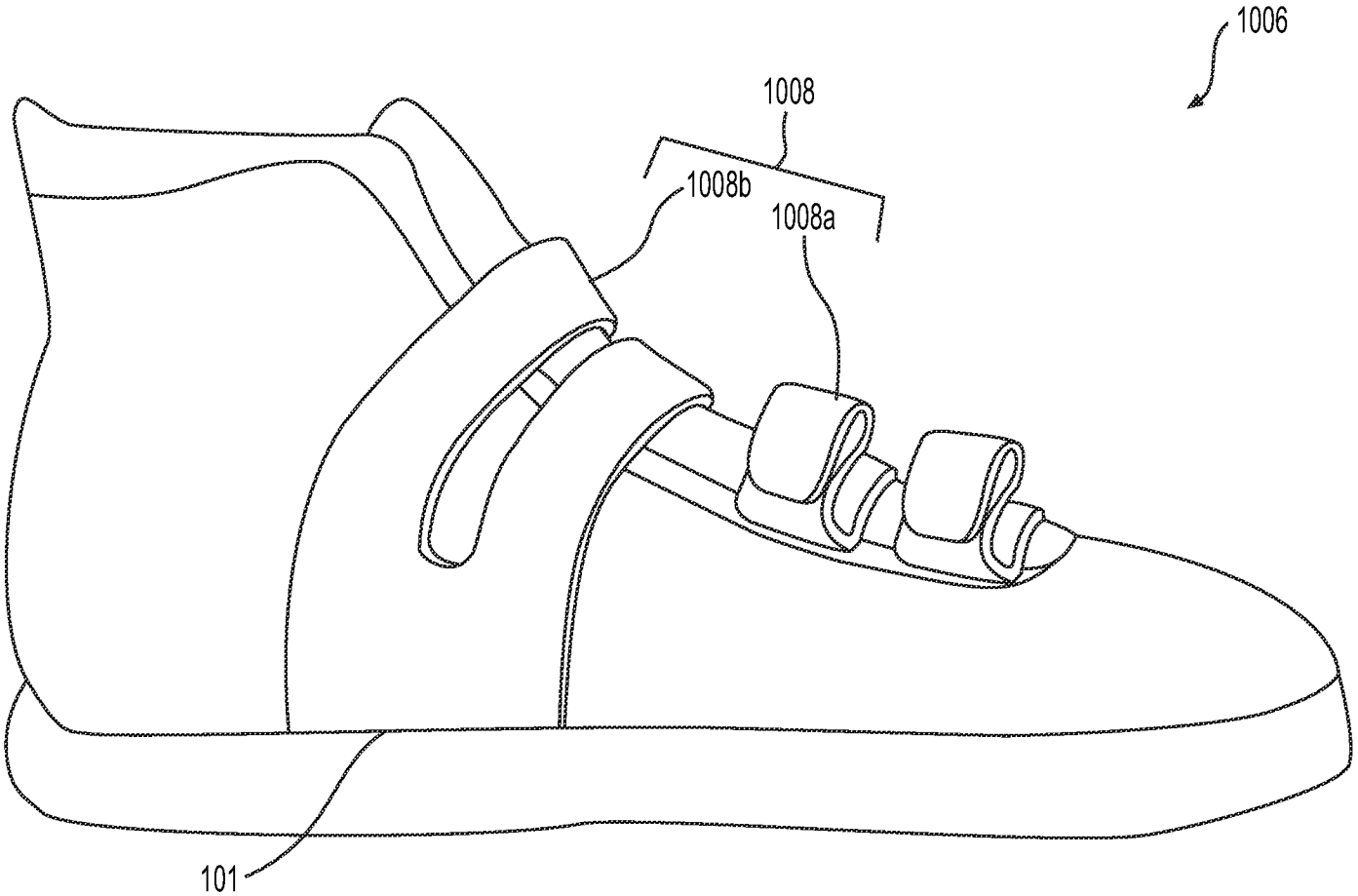
FIG. 5C is a medial perspective view of the alternative embodiment of the article of footwear.

Referring to FIG. 5B, in an alternative embodiment, a closure system 1006 includes a plurality of flaps 1008. The flaps 1008 includes first flap 1008*a* and second flap 1008*b*. First flap 1008*a* is positioned closer toward the anterior end 18 than the second flap 1008*b*. The flaps 1008 may be substantially similar to the flap 108 described above. The second flap 1008*b* is fixed to the bite line 101 (at its respective base portion) on the medial side 44 of the upper 102 in the midfoot region 26. The second flap 1008*b* extends across the upper 102 and the tongue 118 from the medial side 44 to the lateral side 42 (shown in FIG. 5C) in a similar manner in which the flap 108 extends from the lateral side 42 to the medial side 44 as described above. For example, the fingers of second flap 1008*b* extend through tongue 118, and also through apertures (similar to apertures 510) disposed on the lateral side of the article of footwear. The lace loops of second flap 1008*b* are disposed on the lateral side and on an exterior surface of the article of footwear.

Figure 6A:
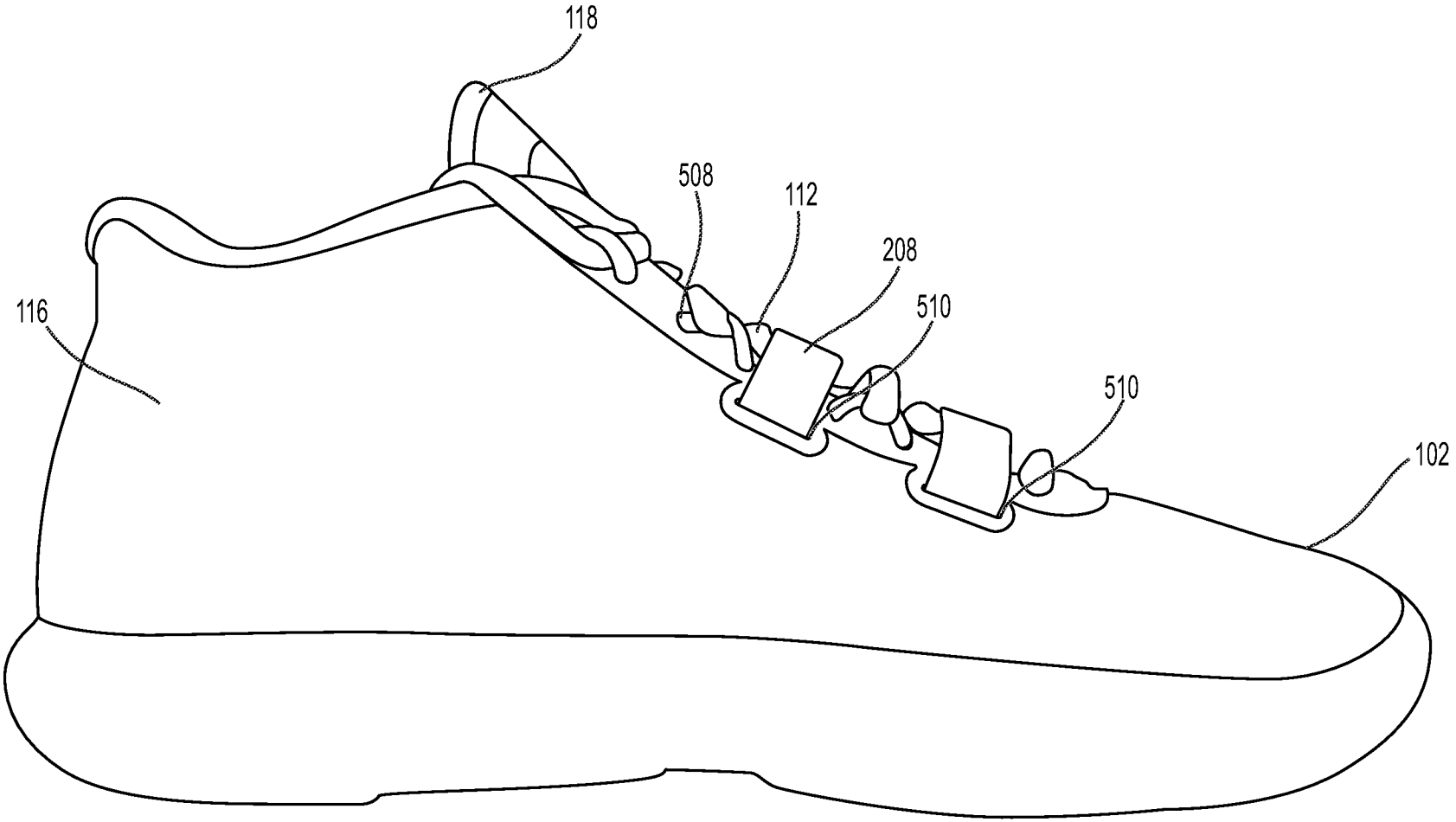
FIG. 6A is another lateral view of the article of footwear of FIG. 1.

Referring to FIG. 6A, the medial side 44 the upper 102 includes the openings 508 configured to receive the at least one lace 112 and the apertures 510 configured to receive the fingers 206 and the lace loops 208. The lace loops 208 have the lace 112 routed through the opening 210. The medial side 44 of the upper 102 includes the first layer 115 and the second layer 116 disposed adjacent to one another.

Figure 6B:
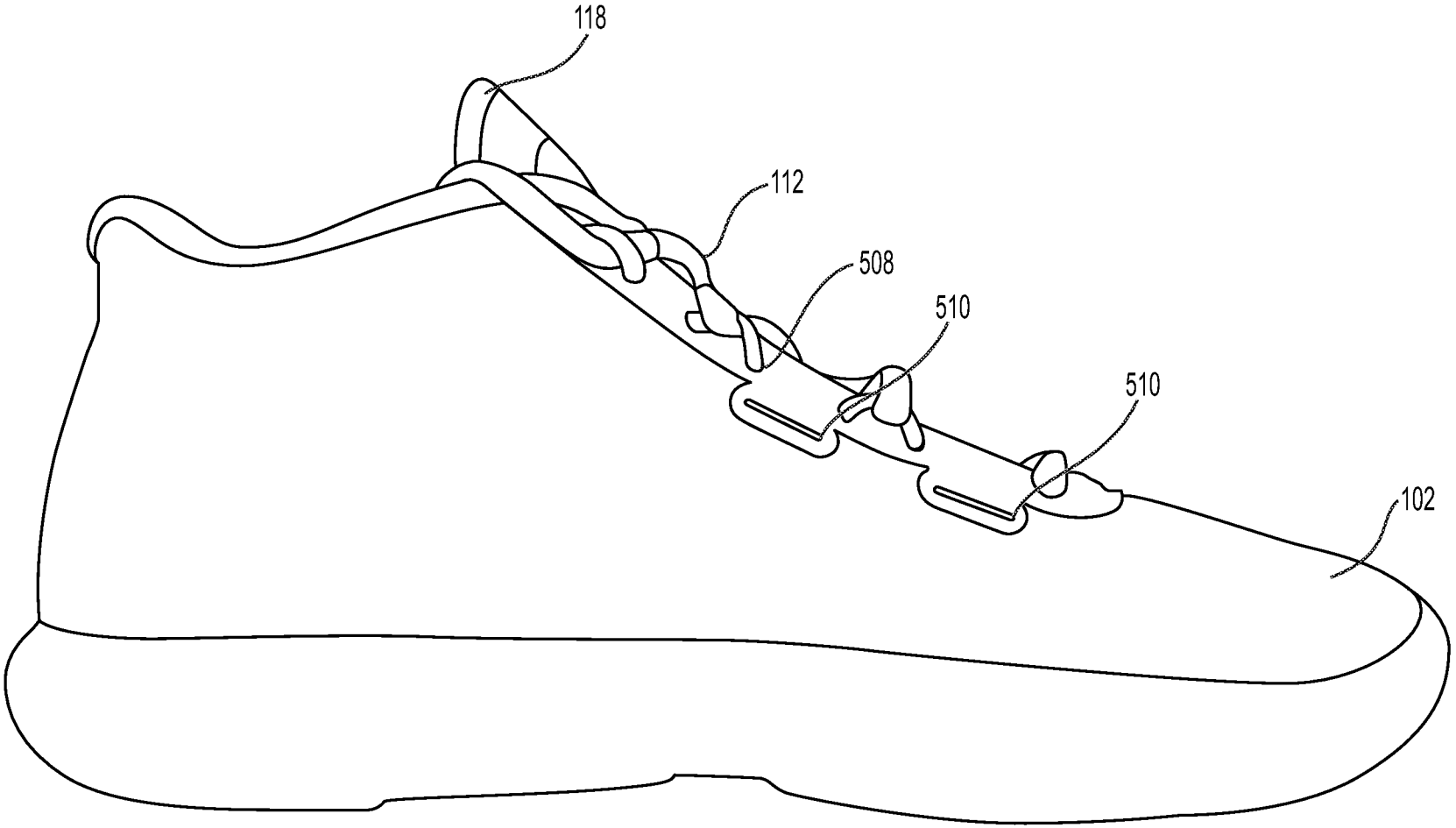
FIG. 6B is a medial view of the article of footwear of FIG. 1.

FIG. 6B shows an alternative view of the medial side 44 of the upper 102 without the flap 108.

The footwear 10 illustrated herein is depicted as athletic footwear configured for sports such as basketball, but the footwear 10 and closure system 106 are not limited to basketball shoes or other sports shoes. The closure system 106 and other features of the article of footwear 10 may be also be used in footwear for various other sports such as but not limited to running, tennis, football, soccer, etc. or in other types of footwear, such as in an article of footwear that is a leisure shoe, a dress shoe, a work shoe, a sandal, a slipper, a boot, or any other category of footwear.

The following clauses provide an exemplary configuration for an article of footwear and sole structure described above.

Clause 1. An article of footwear including: a heel region, a forefoot region, and a midfoot region, the midfoot region disposed adjacent to the forefoot region and the heel region, the article of footwear also including a medial side and a lateral side; an upper extending from the heel region to the forefoot region, wherein the upper includes a plurality of openings through which a fastener is configured to extend; a tongue extending from the forefoot region to the midfoot region; and a flap, the flap extending from the lateral side over a portion of the tongue, toward the medial side, wherein the flap includes a loop through which the fastener is configured to extend.

Clause 2. The article of footwear of Clause 1, further including the fastener.

Clause 3. The article of footwear of Clause 2, wherein the fastener is a lace.

Clause 4. The article of footwear of Clause 1, wherein the flap is configured to extend through the tongue.

Clause 5. The article of footwear of Clause 4, wherein the tongue includes a first layer and a second later, and the flap extends between the first layer and the second layer.

Clause 6. The article of footwear of Clause 5, wherein the first layer is a mesh.

Clause 7. The article of footwear of Clause 1, wherein the flap includes: two loops through which the fastener is configured to extend; a base portion; and two fingers extending away from the base portion, wherein each of the two fingers includes one loop of the two loops.

Clause 8. The article of footwear of Clause 7, wherein the article of footwear further includes a sole structure coupled to the upper at a bite line, wherein the base portion is directly coupled at the bite line on the lateral side.

Clause 9. The article of footwear of Clause 8, wherein the flap is a first flap, and the article of footwear includes a second flap, the second flap extending from the medial over a portion of the tongue, toward the lateral side, wherein the second flap includes a loop through which the fastener is configured to extend.

Clause 10. The article of footwear of Clause 9, wherein the second flap includes a base portion that is coupled to the bite line on the medial side of the article of footwear.

Clause 11. The article of footwear of Clause 9, wherein the second flap is disposed posterior to the first flap.

Clause 12. The article of footwear of Clause 1, wherein the flap has a stiffness that is greater than a stiffness of the tongue.

Clause 13. The article of footwear of Clause 1, wherein the upper further includes an aperture through which the loop extends.

Clause 14. The article of footwear of Clause 13, wherein the loop is disposed on an exterior surface of the upper while a portion of the flap is extended through the aperture.

Clause 15. The article of footwear of Clause 1, wherein the flap further includes a cable extending through an interior of the flap.

Clause 16. An article of footwear including: a heel region, a forefoot region, and a midfoot region, the midfoot region disposed adjacent to the forefoot region and the heel region, the article of footwear also including a medial side and a lateral side; an upper extending from the heel region to the forefoot region, wherein the upper includes a plurality of openings through which a fastener is configured to extend; a sole structure coupled to the upper along a bite line; a tongue extending from the forefoot region to the midfoot region; and a flap having a stiffness greater than a stiffness of the tongue, the flap being coupled to the bite line on the lateral side of the article of footwear, the flap extending from the lateral side over a portion of the tongue, toward the medial side.

Clause 17. The article of footwear of Clause 16, wherein the flap includes a loop through which the fastener is configured to extend.

Clause 18. The article of footwear of Clause 17, further including the fastener.

Clause 19. An article of footwear including: a heel region, a forefoot region, and a midfoot region, the midfoot region disposed adjacent to the forefoot region and the heel region, the article of footwear also including a medial side and a lateral side; an upper extending from the heel region to the forefoot region, wherein the upper includes a plurality of openings through which a fastener is configured to extend; a tongue extending from the forefoot region to the midfoot region; and a flap having a base portion coupled to the lateral side of the article of footwear, the flap also including two fingers each extending from the base portion, over a portion of the tongue, toward the medial side.

Clause 20. The article of footwear of Clause 19, wherein each of the two fingers includes a loop through which the fastener is configured to extend.

We claim:

1. An article of footwear including:

a heel region, a forefoot region, and a midfoot region, the midfoot region disposed adjacent to the forefoot region and the heel region, the article of footwear also including a medial side and a lateral side;

an upper extending from the heel region to the forefoot region, wherein the upper includes a plurality of openings through which a fastener is configured to extend;

a tongue extending from the forefoot region to the midfoot region; and a flap, the flap extending from the lateral side over a portion of the tongue, toward the medial side, wherein the flap includes a loop through which the fastener is configured to extend, and wherein the flap includes two or more support cables extending through an interior of the flap and disposed within a base portion of the flap, each of the two or more support cables comprising a first end and a second end coupled adjacent to a bite line, wherein the first end and the second end of each of the two or more support cables are spaced apart by a gap having an arched shape, and further wherein each of the two or more support cables are configured to follow the arched shape of the gap.

2. The article of footwear of claim 1, further including the fastener.

3. The article of footwear of claim 2, wherein the fastener is a lace.

4. The article of footwear of claim 1, wherein the flap is configured to extend through the tongue.

5. The article of footwear of claim 4, wherein the tongue includes a first layer and a second layer, and the flap extends between the first layer and the second layer.

6. The article of footwear of claim 5, wherein the first layer is a mesh.

7. The article of footwear of claim 1, wherein the flap includes:

at least one additional loop through which the fastener is configured to extend.

8. The article of footwear of claim 7, wherein the article of footwear further includes a sole structure coupled to the upper at the bite line, wherein the base portion is directly coupled at the bite line on the lateral side.

9. The article of footwear of claim 8, wherein the flap is a first flap, and the article of footwear includes a second flap, the second flap extending from the medial side over a portion of the tongue, toward the lateral side, wherein the second flap includes a second loop through which the fastener is configured to extend.

10. The article of footwear of claim 9, wherein the second flap includes a second base portion that is coupled to the bite line on the medial side of the article of footwear.

11. The article of footwear of claim 9, wherein the second flap is disposed posterior to the first flap.

12. The article of footwear of claim 1, wherein the flap has a stiffness that is greater than a stiffness of the tongue.

13. The article of footwear of claim 1, wherein the upper further includes an aperture through which the loop extends.

14. The article of footwear of claim 13, wherein the loop is disposed on an exterior surface of the upper while a portion of the flap is extended through the aperture.

15. An article of footwear including:

a heel region, a forefoot region, and a midfoot region, the midfoot region disposed adjacent to the forefoot region and the heel region, the article of footwear also including a medial side and a lateral side;

an upper extending from the heel region to the forefoot region, wherein the upper includes a plurality of openings through which a fastener is configured to extend;

a sole structure coupled to the upper along a bite line;

a tongue extending from the forefoot region to the midfoot region; and a flap having a stiffness greater than a stiffness of the tongue, the flap being coupled to the bite line on the lateral side of the article of footwear, the flap extending from the lateral side over a portion of the tongue, toward the medial side, and wherein the flap includes at least one support cable, the at least one support cable comprising a first end and a second end coupled adjacent to a bite line, wherein the first end and the second end of the at least one support cable are spaced apart by a gap having an arched shape.

16. The article of footwear of claim 15, wherein the flap includes a loop through which the fastener is configured to extend.

17. The article of footwear of claim 16, further including the fastener.

18. An article of footwear including:

a heel region, a forefoot region, and a midfoot region, the midfoot region disposed adjacent to the forefoot region and the heel region, the article of footwear also including a medial side and a lateral side;

an upper extending from the heel region to the forefoot region, wherein the upper includes a plurality of openings through which a fastener is configured to extend;

a tongue extending from the forefoot region to the midfoot region; and a flap having a base portion coupled to the lateral side of the article of footwear, the flap also including two fingers each extending from the base portion, over a portion of the tongue, toward the medial side, wherein the flap further comprises two or more support cables extending through an interior of the flap, wherein each of the two or more support cables follow a gap having an arched shape.

19. The article of footwear of claim 18, wherein each of the two fingers includes a loop through which the fastener is configured to extend.

* * * * *